United States Patent [19]

Francel

[11] Patent Number: 4,506,830

[45] Date of Patent: Mar. 26, 1985

[54] DEVICE FOR SIMULTANEOUS CONTROL OF AIR FLOW AND CIRCULATION SPEED FOR AN AIR CONDITIONING INSTALLATION WITH VARIABLE AIR FLOW

[76] Inventor: Georges Francel, 7 Boulevard Auguste Raynaud, 06110 Nice, France

[21] Appl. No.: 595,468

[22] Filed: Mar. 30, 1984

[30] Foreign Application Priority Data

Apr. 1, 1983 [FR] France ..... 83 05645

[51] Int. Cl.[3] ..... F24F 7/00

[52] U.S. Cl. ..... 236/49; 236/82

[58] Field of Search ..... 236/49, 13, 82

[56] References Cited

U.S. PATENT DOCUMENTS

| | | | |
|---|---|---|---|
| 4,040,564 | 8/1977 | Waeldner et al. . | |
| 4,291,832 | 9/1981 | Ginn et al. | 236/80 R X |
| 4,334,648 | 6/1982 | Buth et al. | 236/49 |
| 4,449,664 | 5/1984 | Mithuhira | 236/49 |

FOREIGN PATENT DOCUMENTS

| | | |
|---|---|---|
| 2188113 | 1/1974 | France . |
| 2216498 | 8/1974 | France . |

*Primary Examiner*—William E. Wayner

*Attorney, Agent, or Firm*—Watson, Cole, Grindle et al.

[57] ABSTRACT

The device includes a pressure-reducing chamber arranged immediately upstream of an air conditioning diffuser. It includes a shutter which pivots about an axis and which tends to reduce the useful area of the diffuser in question, under the action of a counterweight.

The air introduced into the chamber, by means of a normally open motorized damper, exerts on one of the faces of the shutter, a pressure which tends to oppose the effect of the counterweight and tends to increase the useful area of the diffuser.

A sensor which serves as a stop during the opening of the shutter, reacts on the motorized damper to tend towards a balance of the forces applied on the shutter, for a particular area of diffusion defined by the position of the sensor.

The displacement of the sensor, operated by an ambient thermostat for example, enables the variation of the airflow by changing the free area of circulation.

The speed of circulation is practically constant and depends on the counterweight acting on the shutter.

13 Claims, 5 Drawing Figures

DEVICE FOR SIMULTANEOUS CONTROL OF AIR FLOW AND CIRCULATION SPEED FOR AN AIR CONDITIONING INSTALLATION WITH VARIABLE AIR FLOW

BACKGROUND OF THE INVENTION

In the field of air conditioning, the diffusion of the conditioned air in the rooms of a building is established as a principal problem in obtaining the comfort perceived by the users.

Systems with variable airflow increase the technical problems such as cold air downdraughts, the mutual inter-reactions of the diffusers, the pressure variations in the distribution ducts, etc.

To resolve these problems, the devices such as those disclosed, for example, in the French patents below, are currently known:

Pat. No. 71/15,589 of Apr. 30, 1971;
Pat. No. 73/08,304 of Mar. 8, 1973;
Pat. No. 73/10,096 of Mar. 21, 1973;
Pat. No. 75/02,241 of Jan. 24, 1975;
Pat. No. 76/19,413 of June 25, 1976;
Pat. No. 76/20,471 of July 5, 1976;
Pat. No. 79/06,705 of Mar. 16, 1979.

The corresponding equipment currently on the market has disadvantages such as:

operation with relatively high air pressure creating a perceptible sound level, absence of control of the airflow, which must be otherwise achieved, necessity to obtain similar pressures of low value upstream of each diffuser, which necessitates an oversizing of the distribution ducts, absence of control of the diffusion of air preventing variations of airflow in the desired proportions, complication of the systems resulting in a high price.

SUMMARY OF THE INVENTION

The object of the present invention is to avoid these disadvantages by defining a simple system able to operate at low pressure, allowing variations of airflow in substantial proportions and operating without the pressure variations which can occur in the conditioned air distribution system disturbing the airstream characteristics at any point of diffusion.

In the device which forms the subject of the invention and which is designed to obtain this result, a shutter, arranged immediately upstream of the point of air diffusion, is subjected to a return force created by a spring or a counterweight in such a way that the shutter obstructs the air circulation section, whilst the circulating air tends to open the circulation area up to a position where the shutter encounters a sensor which reacts on a motorised damper situated upstream of the shutter. The flow, the speed of circulation and the area of diffusion are then constant and independent of the air pressure prevalent upstream of the air damper. The displacement of the sensor allows the useful area of circulation to be varied and, therefore, the airflow, at the same time maintaining a speed of circulation sufficient to ensure a good diffusion of air in the treated space.

The control of the speed and the control of the flow of air are thus achieved by one and the same device.

The description below, which refers to the drawing given by way of example, will provide a good understanding of how the invention can be produced.

DETAILED DESCRIPTION OF THE PREFERRED EMBODIMENTS

Figure 1A:
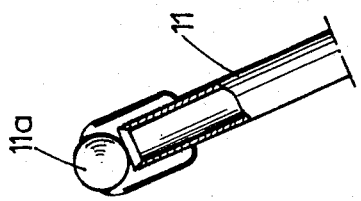
FIG. 1*a* shows a larger scale detail.
Figure 1:
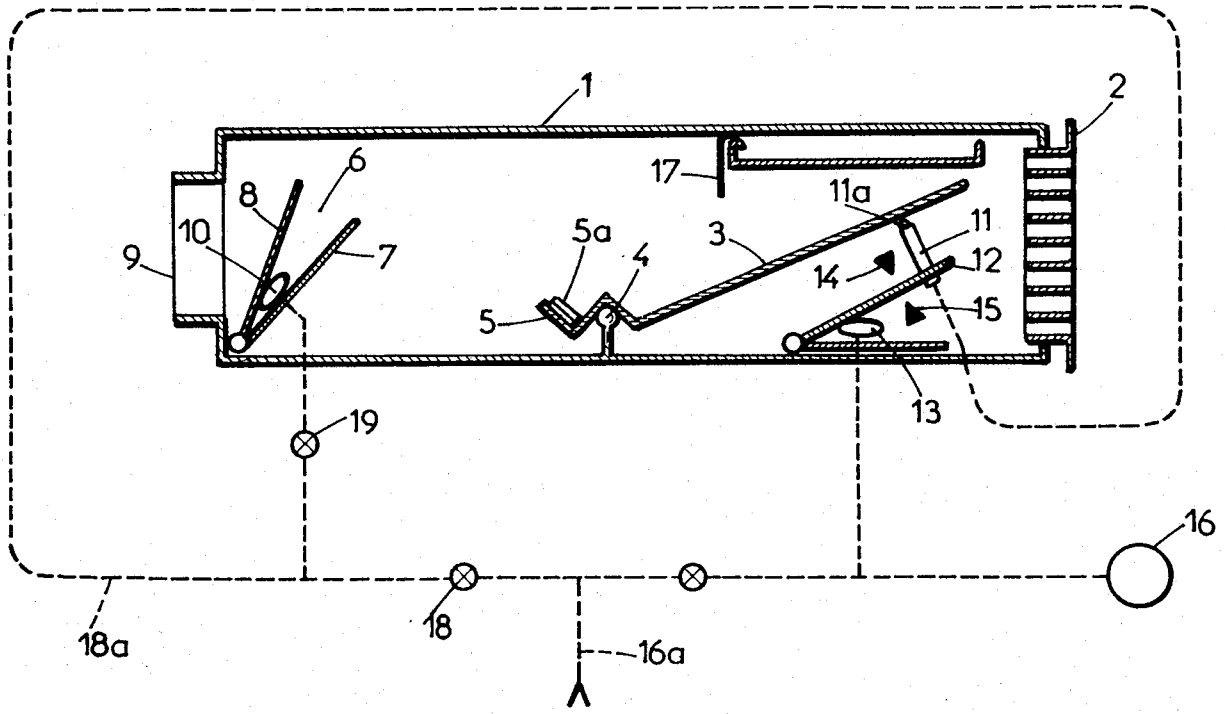
FIG. 1 shows a section of the inventive system of control in its preferred configuration.

In FIG. 1, a chamber 1 formed of galvanized sheet steel constitutes a pressure-reducing box between the distribution duct connected at 9 and the diffuser 2 of the wall type which can include directional vanes to guide the steam of circulated air in a suitable manner. The connection between the distribution duct and the chamber indicated above is made by means of a circular flexible duct.

The invention concerns essentially the device arranged within the chamber, to ensure the automatic regulation of the airflow and the control of the diffusion.

The device includes:

a shutter 3 constituted by a bent aluminium sheet, articulated on a blade 4 and fitted with a counterweight 5 which determines a rest position for the shutter, such that the latter obstructs the circulation area and such that the air circulating in the chamber tends to cause the shutter to pivot whilst progressively opening the circulation area towards the diffuser 2; the counterweight is adjustable by addition of sheet metal plates 5*a* simply placed in one of the bends of the mobile sheet 3;

a motorized damper 6 constituted by two sheet metal plates, mutually articulated, one of which, 7, is in a fixed position and inclined next to the air entry orifice 9 in the chamber 1, in such a way that the second sheet 8, which is movable, is able to obstruct the air entry orifice 9, when this sheet is in its vertical position.

Motorization of this damper is achieved by an inflatable component 10 arranged between the two sheet metal plates. With the objective of perfecting the airtightness of the damper and of reducing air noises which can occur on closure of the damper, the movable plate 8 can be covered with a felt or a sheet of foam rubber for example;

a pneumatic sensor 11, constituted by a nozzle system (FIG. 1*a*) able to be obstructed by a ball 11*a* arranged next to the shutter 3, in such a way that, as it opens, the shutter comes into contact with the ball which shuts off the nozzle. This sensor is fixed on a movable sheet metal plate 12 which can be displaced under the action of an inflatable component 13 in such a way that it can adopt a position more or less close to the rest position of the shutter 3. The two extreme positions of the sensor are determined by two adjustable mechanical stops 14 and 15. The inflatable component 13 associated with the sensor can be operated by an ambient thermostat 16 sensitive to the temperature of the building or to any other space to be controlled;

a device 17 for air distribution, intended to equalize the air speed over the different points of the diffuser area used and constituted by a sheet metal deflector arranged perpendicularly to the airstream upstream of the variable opening of the shutter 3.

The operation of this device can be explained as follows:

Before start-up of the fan of the installation concerned, the shutter 3, in the rest position, under the effects of its counterweight 5, is in a top position and obstructs the circulation area. Assuming that the installation is distributing cold air and that the temperature of the heated building is higher than the setting of the ambient thermostat 16, this latter causes a zero pressure in a pneumatic circuit connected to the inflatable component 13 of the sensor 11 and, as a result, this latter, under the effect of the weight of the sheet which supports it, is in a low position.

As a result of the two preceding situations, the sensor 11 is at a distance from the shutter 3 and the ball 11*a* allows the pressure of the pneumatic circuit to which the sensor is connected, to escape.

This pneumatic circuit, supplied at FIG. 16*a* by a suitable source of air under pressure, includes a restriction or calibrated orifice 18, downstream of which is situated a branch 18*a* to supply the sensor 11 then a second restriction or calibrated orifice 19 arranged at the entry to the inflatable component 10 of the motorized damper 6.

It can be deduced that the pressure in the inflatable component 10 of the motorized damper 6 is zero and that this latter, under the effects of the weight of the movable sheet 8, is in the open position.

When the air conditioning installation fan is started up, the quantity of air introduced into the system is too large because the motorized damper 6 is fully open. Under the predominant effect of the air pressure exerted on its upstream face, the shutter 3 opens until it comes into contact with the sensor 11.

This contact causes the closure of the nozzle by the ball 11*a*, which gives rise to an increase in pressure between the two restrictions or calibrated orifices 18 and 19 of the air circuit operating the motorized damper 6. This pressure causes, through the intermediary of the second restriction 19, a progressive increase in the pressure inside the inflatable component 10 of the motorized damper 6, which as a result closes slowly.

This closing movement continues until the airflow is brought to the value which corresponds to the balancing of the shutter 3, this latter then freeing the ball 11*a* of the sensor which gives rise to a reopening cycle of the damper 6 and so on.

The oscillation movements of the shutter 3 corresponding to the above-indicated operation, are damped by the second restriction 19 in such a way that they can be considered as negligible in the sense that they are imperceptible at the point of inert stream diffusion.

The airflow is then maximum and fixed on the one hand by the position of the corresponding stop 15 of the sensor 11, which fixes the maximum free area of the diffuser, and on the other hand by the value of the counterweight 5 which fixes the air pressure exerted on the upstream face of the shutter 3 at the moment when this latter is in balance, which fixes the speed of circulation. In these circumstances, the airflow can be considered to be constant and independent of the upstream pressure of the motorized damper 6 since this latter, operated by the sensor 11, reacts instanteously.

When the temperature of the treated building drops and tends towards the setting of the thermostat 16, this latter causes an increase in pressure in the pneumatic circuit connected to the inflatable component 13 associated with the sensor 11, which causes the upwards displacement of this latter and leads to a new balance of the shutter 3.

The new position of this shutter reduces the free area of diffusion, which diminishes the circulated airflow. The speed depending on the configuration of the shutter and on its counterweight can be considered as constant in the zone of utilisation.

When the temperature of the building is reached, the position of the sensor is fixed by the stop 14 corresponding to the minimum airflow.

When the temperature of the building tends to rise again, the opposite cycle is established to increase the airflow progressively.

It should be noted that for a given position, even intermediate, of the sensor, the flow is not disturbed by the air pressure variations which can exist in the distribution duct.

It has previously been said that the oscillations of the shutter 3, around the position of contact with the sensor, are negligible and do not disturb the stability characteristics of the circulation airstream in the treated environment.

It should be noted, however, that these oscillations can give rise to a slight noise corresponding to the contact of the shutter on the sensor. This noise can easily be eliminated by the use of a soft material applied to the shutter in the zone of contact with the sensor.

It should also be noted that the configuration of the shutter and of its counterweight can be selected so that the speed of circulation, instead of being constant, is a function of the position of the shutter with the objective of improving the characteristics of the desired diffusion.

With a low flow, for example, a higher circulation speed can be chosen to preserve a virtually constant radius of diffusion. To this end, it is sufficient that the center of gravity of the movable equipment constituted by the shutter 3 and the counterweight 5 moves away appreciably from the vertical plane passing through the axis of rotation progressively as the shutter reascends and reduces the air circulation area.

As has been previously stated, the regulation system can be of the pneumatic type. The most usual systems with pneumatic regulation employ compressed air at a pressure of 1 $kg/cm^2$ approximately. For the system which forms the subject of the invention, and particularly for the configuration described by way of a non-limiting example, a lower compressed air pressure can be chosen for the supply to 16*a*, of the order of 50 cm water gauge, which offers many advantages. In this case, the production of compressed air is silent and of low cost, which enables its use even in the case of small or medium-sized installations.

In addition, the configuration of the mechanical parts and of the inflatable components previously mentioned is of simpler construction.

Most regulation systems include a regulating means, the position of which is significant from the point of operation in the work zone at a given instant. But, in most cases, the position of this regulating means is not proportional to the effect produced on the overall space to be controlled.

It may be noted that the system of regulation described in this description includes a movable part 3 which changes the free area of the air diffuser. This area can be considered as proportional to the air flow and therefore to the power developed in the treated enclosure. This enables the percentage workload of the installation at a given moment to be visualized, and also, facilitates the regulating of minimum and maximum flow without the need to use charts, and without the need to carry out calibrations during construction.

Figure 2:
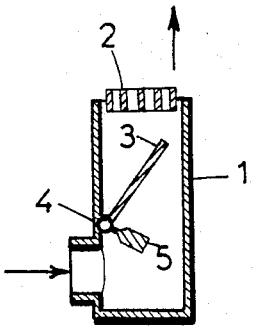
FIGS. 2, 3 and 4 are partial sections of alternatives.
Figure 3:
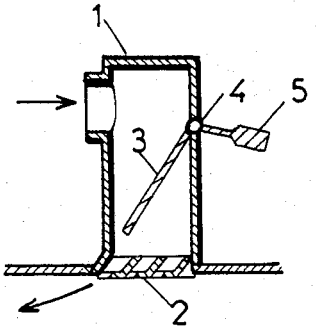
Figure 4:
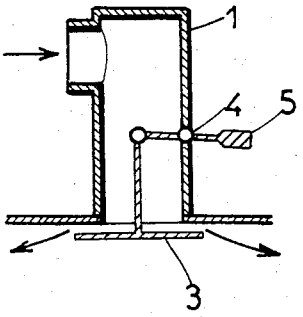

The device which forms the subject of the invention can be fitted to diffusers other than the wall type diffusers. By way of example:

FIG. 2 shows, in sectional view, the arrangement of the shutter 3 which can be associated with a floor grille or a breast-wall grille enabling a vertical circulation; FIG. 3 shows, in sectional view, the arrangement of the shutter which can be associated with a linear ceiling diffuser; FIG. 4 shows, in sectional view, the arrangement of a movable device, in round, rectangular or square shape, which enables a ceiling type diffusion.

The device can also be applied in fields other than air conditioning, with gaseous fluids other than air or with liquids, whenever it is desired to control simultaneously a fluid flow and a speed of injection of this fluid.

I claim:

1. In a distributor means for distributing conditioned air into a room, said distributor means including a diffuser at its downstream end for discharging the conditioned air into the room and a shutting device located immediately upstream of said diffuser for controlling the flow of conditioned air which passes thereby towards said diffuser, said shutting device being mechanically biased so as to move to reduce the flow of conditioned air which flows therepast towards said diffuser yet movable against said bias by the pressure of the conditioned air flowing therepast to increase said flow of conditioned air, the improvement wherein said distributor means includes (a) a sensor which is capable of emitting signals when contacted by said shutting device, said sensor being located so as to be contactable by said shutting device when it is moved in response to increases in the pressure of the conditioned air flowing therepast, (b) first adjusting means, said first adjusting means being associated with said sensor to control its positioning with respect to said shutting device in response to the conditions in said room, (c) an air damper located upstream of said shutter device, said air damper being movable to control the flow of conditioned air towards said shutter device such that said shutter device can be caused to move in a constantly oscillating fashion in and out of contact with said sensor, and (d) second adjusting means, said second adjusting means being associated with said air damper so as to control its positioning in response to signals from said sensor.

2. The distributor means as defined in claim 1, wherein said shutting device comprises an elongated metal sheet and a blade about which said elongated metal sheet pivots, the orientation of said elongated metal plate about said blade controlling the flow of conditioned air past said shutting device.

3. The distributor means as defined in claim 2, wherein said elongated metal sheet includes a first long portion, a second short portion and a bend therebetween, wherein said elongated metal sheet is positioned such that the bend therein is on said blade, and wherein the orientation of said first portion of said elongated metal sheet about said blade controls the flow of conditioned air past said shutting device.

4. The distributor means as defined in claim 3, including at least one counterweight positionable on the second portion of said elongated metal sheet so as to mechanically bias said elongated metal sheet about said blade to cause the first end thereof to reduce the flow of conditioned air past said shutting device.

5. The distributor means as defined in claim 1, including a pneumatic circuit connected between said sensor and said second adjusting means, and wherein said sensor comprises a pneumatic tube having a ball at its end nearest said shutting device, movement of said shutting device against said ball causing said ball to block off said end of said tube, said tube then emitting a signal in the form of a fluid impulse into said pneumatic circuit.

6. The distributor means as defined in claim 5, wherein said first adjusting means comprises a movable plate to which said sensor is attached and an inflatable element located on the side of said movable plate opposite to the side facing said shutting device, said movable plate being pivotable about a horizontal axis toward and away from said shutting device, inflation of said inflatable element causing said movable plate and thus said sensor to move towards said shutting device.

7. The distributor means as defined in claim 6, wherein said inflatable element is connected to said pneumatic circuit.

8. The distributor means as defined in claim 6, including two movable stop means, said stop means being positioned on opposite sides of said movable plate to define the limits of movement of said metal plate toward and away from said shutting device and thus the minimum and maximum flow areas determinable by said shutting device.

9. The distributor means as defined in claim 5, wherein said second adjusting means comprises an inflatable element, and wherein said inflatable element is connected to said pneumatic circuit.

10. The distributor means as defined in claim 5, wherein said pneumatic circuit is connected to a thermostat located in said room.

11. The distributor means as defined in claim 5, wherein said pneumatic circuit includes at least one calibrated orifice to control the flow of pneumatic fluid to said second adjusting means.

12. The distributor means as defined in claim 1, including a chamber in which said shutting device is located and a deflecting means located within said chamber, said deflecting means acting to equalize the speed of the conditioned air as it contacts said diffuser.

13. The distributor means as defined in claim 1, wherein said diffuser includes shutters which control the direction of flow of the conditioned air as it enters said room from said diffuser.

* * * * *